US005666669A

United States Patent [19]

Sewell

[11] Patent Number: 5,666,669

[45] Date of Patent: Sep. 16, 1997

[54] CAP WITH SHORTENED BILL

[76] Inventor: Louis Sewell, 736 Boxwood Dr., Pensacola, Fla. 32503

[21] Appl. No.: 613,543

[22] Filed: Mar. 11, 1996

[51] Int. Cl.[6] ..... A42B 1/04

[52] U.S. Cl. ..... 2/195.1; 2/10

[58] Field of Search ..... 2/10, 12, 195.1

[56] References Cited

U.S. PATENT DOCUMENTS

D. 266,370 10/1982 Boden ..... D2/244

5,075,898 12/1991 Bedient ..... 2/10

*Primary Examiner*—Diana Biefeld

*Attorney, Agent, or Firm*—Peter Loffler

[57] ABSTRACT

A modified baseball cap comprises a dome-shaped shell having optional size adjustment means located thereon. A bill of shortened outward length is either securely or releasably attached to the cap.

4 Claims, 3 Drawing Sheets

CAP WITH SHORTENED BILL

BACKGROUND OF THE INVENTION

1. Field of the Invention

The present invention relates to head wear and more specifically to a baseball cap having a shortened and removable bill.

2. Background of the Prior Art

Baseball is the American national pastime. From spring to autumn, millions of Americans flock to baseball parks, big and small, in order to participate as either competitors or spectators in Doubleday's great sport. Fans around the world, notably Canada, Japan, and Taiwan also ride high on the baseball bandwagon.

Baseball, while not being rich in exotic accouterments, has a few required pieces of equipment in order to play the sport. These pieces of equipment include, the ball, the bat, the gloves, the bases, and the baseball cap. The baseball cap with its extended bill, shields a player's eyes from the glare of the sun or night-lights and permit the player to properly effect a particular play despite adverse light conditions. It would be hard to imagine the game of baseball without this piece of equipment.

The standard baseball cap is a generally crown-shaped or dome-shaped shell that fits on the upper portion of a wearer's head and does not extend over the wearer's ears. A visor or bill extends outwardly from the front of the shell. The bill typically extends outwardly from four to seven inches or more. The bill's main purpose is to shade a baseball player's eyes from the glare of either the sun or powerful night-lights.

Many people, including fans that have never touched a baseball bat, wear a baseball cap in order to show support for their favorite team. These people wear the baseball cap in order to make a statement and not as a required equipment item. As such, such wearers lack the functional necessity of the extended length of the bill that current baseball caps sport. The extended length of a cap's bill may even prove burdensome. An extended bill may not only be not required, it may also be not desired.

In tight quarters, such as in a crowded train or while wearing a motorcycle helmet, the extended bill causes an interference. In tight areas such as malls or construction sites, the extended bill can strike protruding objects. Therefore, fans who wear baseball caps for non-functional reasons, are better suited with a cap that has a shortened or even removed visor.

Short or no bill baseball caps are not currently known in the art. Therefore, there is a need in the art for a baseball cap that has a shortened or non-existent bill.

SUMMARY OF THE INVENTION

The baseball cap of the present invention meets the above-identified needs in the art. The baseball cap is a standard baseball cap that has a shortened bill which bill does not interfere with protruding objects that a wearer may encounter.

The baseball cap of the present invention is comprised of a dome- or crown-shaped shell designed to be worn by a person in the usual way. The shell may have any standard size-adjustment means. A relatively short bill extends outwardly from the front of the cap. The bill may optionally be removably attached to the cap by appropriate attachment means.

The baseball cap of the present invention is designed to be worn by a person who desires to show support but lacks the functional necessity of a standard baseball cap bill. The cap, with its shortened or even removable bill, is not only more aesthetically appealing than a regular baseball cap, but is also easier to wear in tight quarters. The baseball cap carries all the standard fan support with it. The invention is easy to construct requiring only standard manufacturing techniques for its production.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
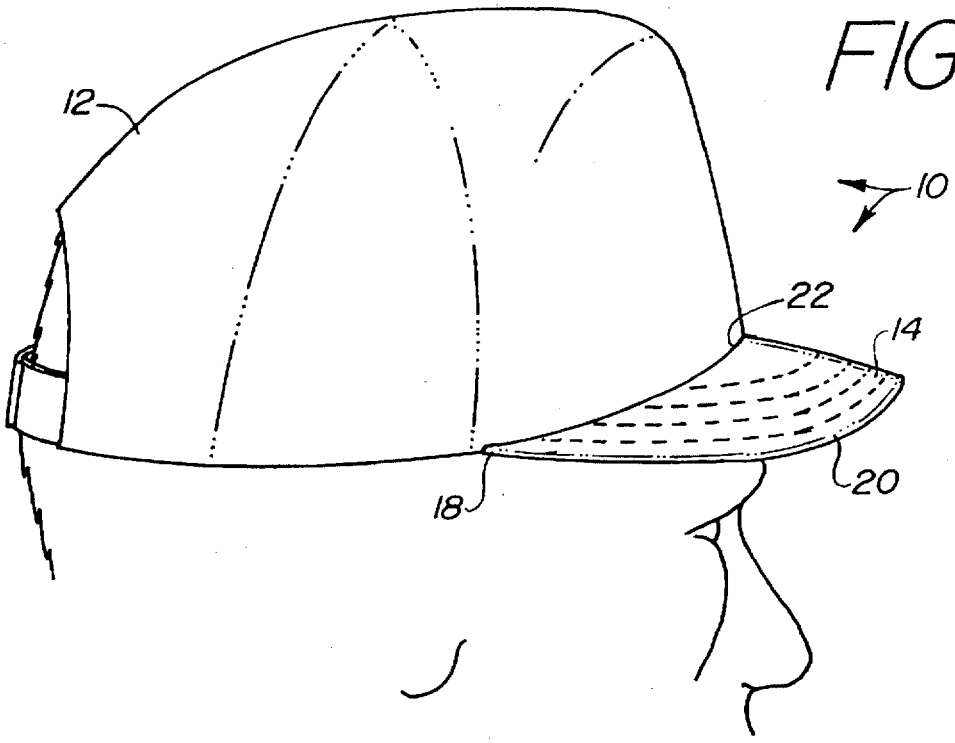
FIG. 1 is an isometric view of the cap of the present invention being worn by a person.
Figure 2:
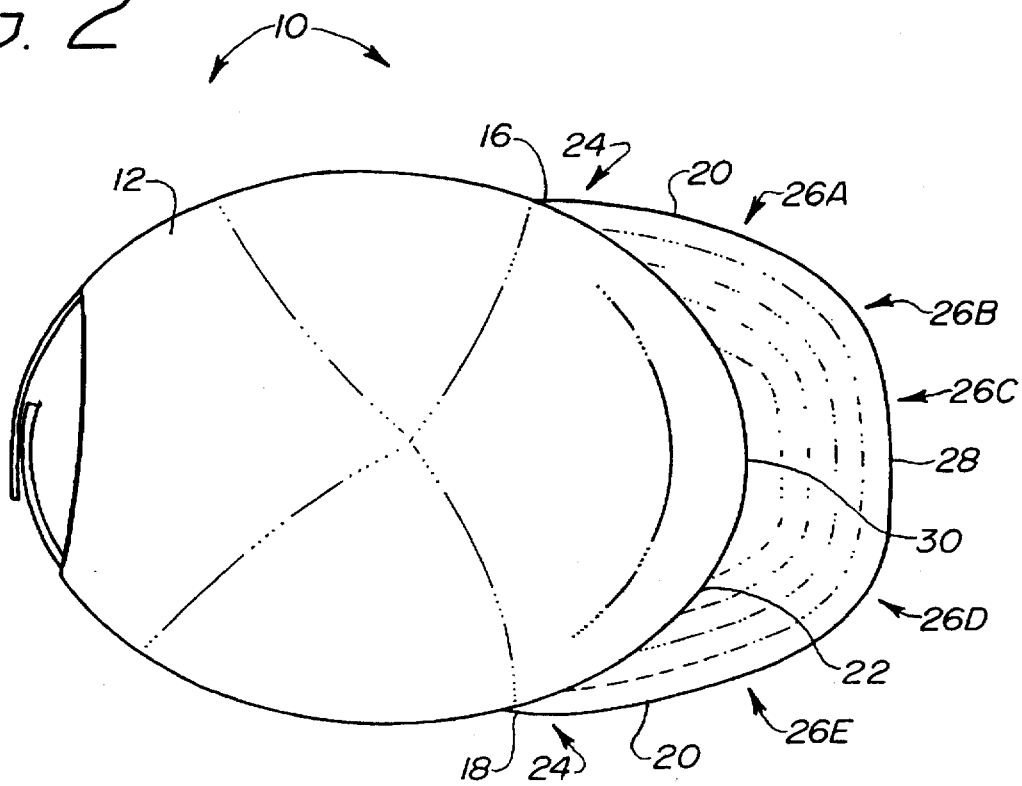
FIG. 2 is a top plan view of the cap of the present invention.
Figure 3:
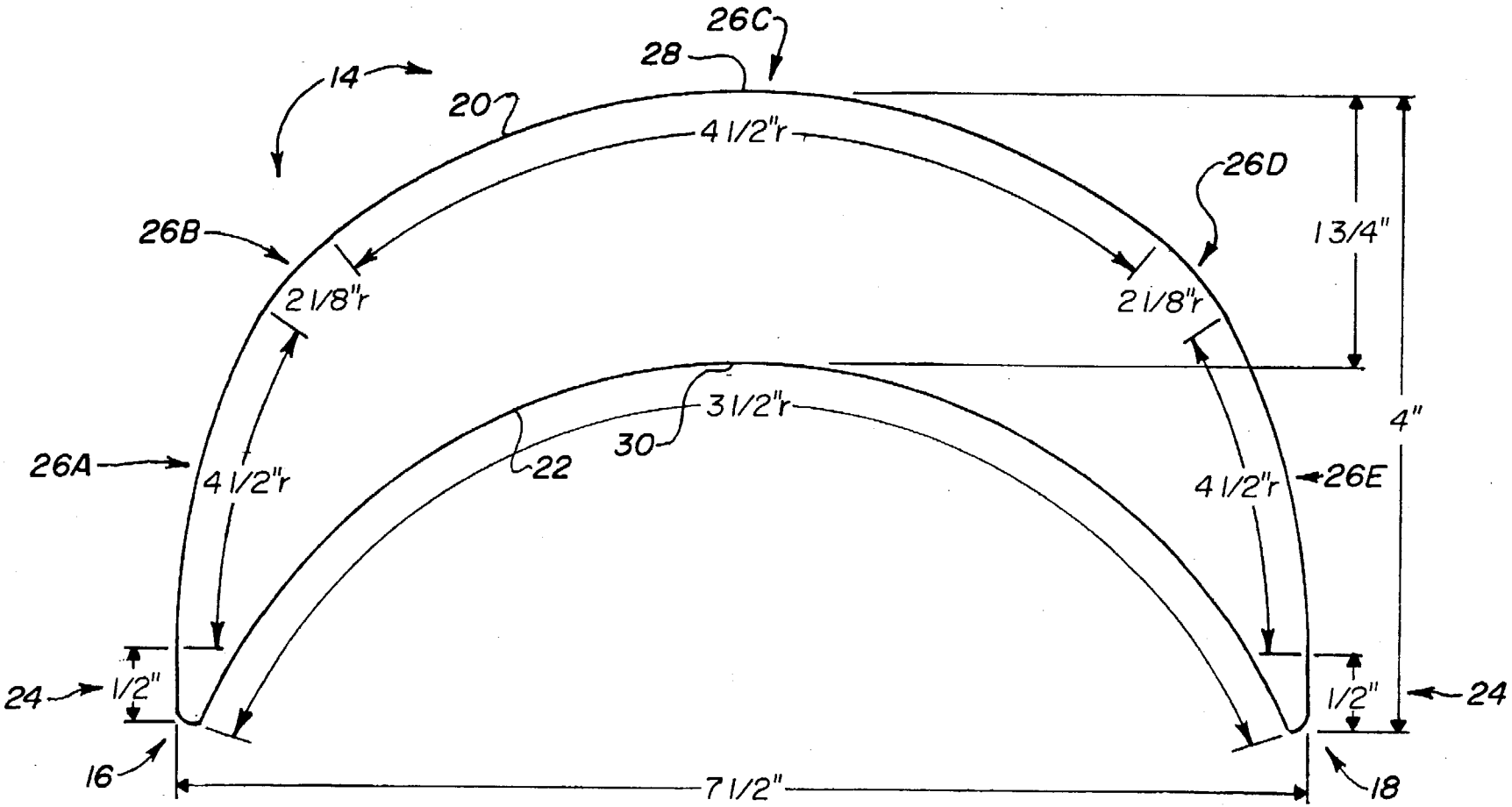
FIG. 3 is a dimensional view of the bill of the cap.

Referring now to the drawing, it is seen that the cap of the present invention, generally denoted by reference numeral 10, is comprised of a generally hemispherically-shaped shell 12, sized to fit onto a user's head and worn above the wearer's ears. The shell 12 may have size-adjustment means of any appropriate type, including Velcro, elastic band, cooperating belt and buckle, and cooperating protrusions and receptacles, on the backside. Located on the front of the shell 12 and extending outwardly, is a bill 14. The bill 14 extends outwardly a distance that is shorter than a bill of a standard cap found in the art.

As seen in FIG. 1, the bill 14 is generally crescent-shaped having a first end 16, a second end 18, an outer edge 20, and an inner edge 22. The outer edge 20 is mostly curved having five continuous sections of differing radius. Located on either end of the outer edge are straight sections 24 that are not curved. The straight sections are each about, or less than, ½ inch in length. The first curved section **26*a* has a radius of about 4½ inches, the second curved section 26*b* has a radius of about, or less than, 2⅛ inches, the third curved section 26*c* has a radius of about, or less than, 4½ inches, the fourth curved section 26*d* has a radius of about, or less than, 2⅛ inches, and the fifth curved section 26*e*** has a radius of about, or less than, 4½ inches.

The inner edge 22 has a radius of about, or less than, 3½ inches.

The distance between the midpoint 28 of the outer edge 20 and the midpoint 30 of the inner edge 22 is about, or less than, 1¾ inches. The distance between the first end 16 and the second end 18 is about 7½ inches.

Figure 4:
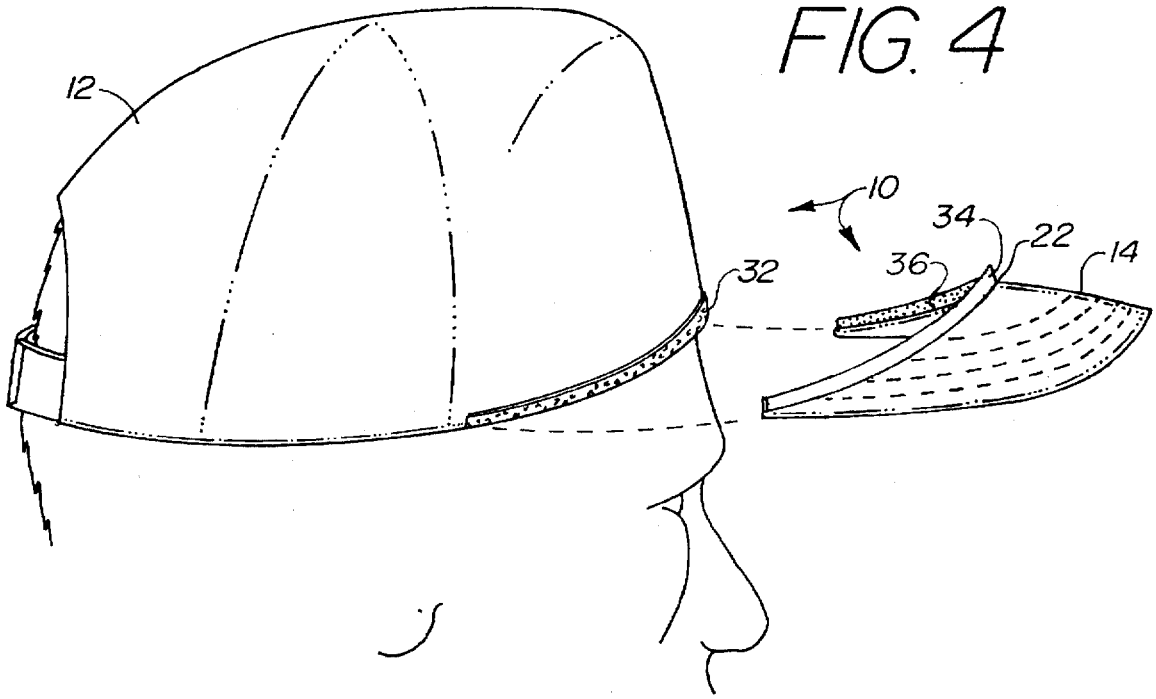
FIG. 4 is a partially exploded view of an alternate embodiment of the present invention.
Figure 5:
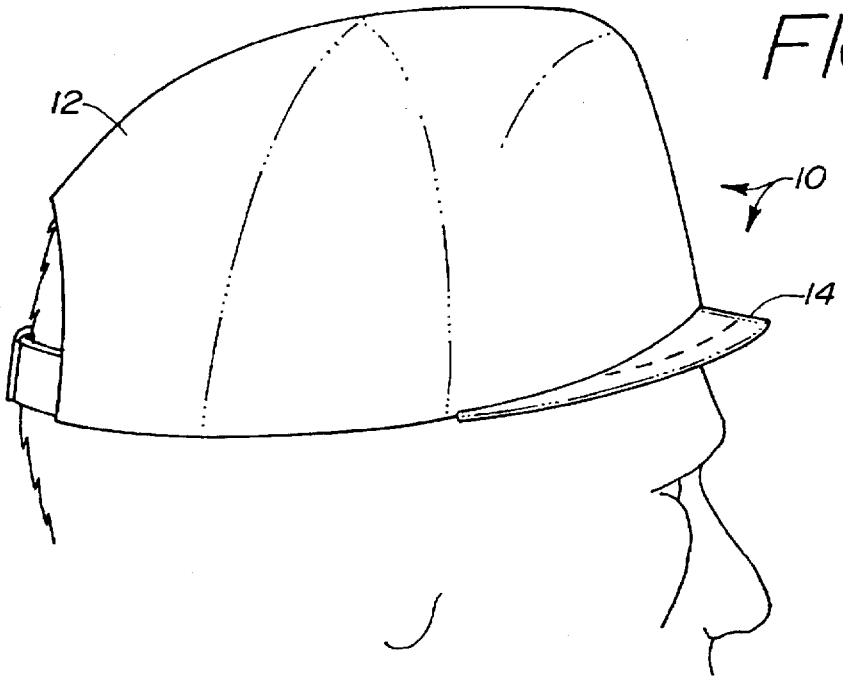
FIG. 5 is an isometric view of an alternate embodiment of the cap of the present invention.

As seen in FIG. 4, in an alternate embodiment of the cap 10 of the present invention, a first section 32 of cooperating hook and loop (Velcro) material, in corresponding length to the length of the inner edge 22, is located on the front of the shell 12. The bill 14 has a small flange 34 extending along the length of the inner edge, the face of the flange in generally perpendicular orientation to the plane of the bill 14. A second section 36 of cooperating hook and loop material is located along the length of the flange 34. The bill 14 is fitted onto the shell 12 such that the first section 32 of hook and loop material is mated with the second section 36 of hook and loop material. This mating of the two sections of hook and loop material secures the bill 14 to the shell 12 and makes the bill 14 releasably attachable to the shell 12.

While the invention has been particularly shown and described with reference to ah embodiment thereof, it will be understood by those skilled in the art that various changes in form and detail may be made without departing from the spirit and scope of the invention.

I claim:

1. A cap comprising:

a generally hemispherical shell to fit the head of a person;

an adjustment means for adjusting the circumference of the shell; and a bill comprised of an outer edge, an inner edge having a radius of about 3½ inches a first straight section having a length of about ½ inches and a first curved section having a radius of about 4½ inches integral with the first straight section and a second curved section having a radius of about 2⅛ inches integral with the first curved section and a third curved section having a radius of about 4½ inches integral with the second curved section and a forth curved section having a radius of about 2⅛ inches integral with the third curved section and a fifth curved section having a radius of about 4½ inches integral with the fourth curved section and a second straight section having a length of about ½ inch integral with the fifth curved section, a first midpoint at the inner edge, a second midpoint located about 1¾ inches from the first midpoint, the bill being attached to the shell.

2. The device as in claim 1 wherein the distance between the first straight section and the second straight section is about 7½ inches.

3. The device as in claim 1 wherein the bill is releasably attached to the shell.

4. The device as in claim 1 to further comprising:

a flange, attached to the inner edge, in generally perpendicular orientation to the plane of the bill;

a first section of hook and loop material attached to the flange; and a second section of hook and loop material attached to the shell.

* * * * *